US006787690B1

(12) United States Patent
Celi et al.

(10) Patent No.: US 6,787,690 B1
(45) Date of Patent: Sep. 7, 2004

(54) STRINGED INSTRUMENT WITH EMBEDDED DSP MODELING

(75) Inventors: Peter J. Celi, Agoura Hills, CA (US); Michel A. Doidic, Westlake Village, CA (US); David W. Fruehling, Simi Valley, CA (US); Marcus Ryle, Westlake Village, CA (US)

(73) Assignee: Line 6, Agoura Hills, CA (US)

( * ) Notice: Subject to any disclaimer, the term of this patent is extended or adjusted under 35 U.S.C. 154(b) by 0 days.

(21) Appl. No.: 10/197,363

(22) Filed: Jul. 16, 2002

(51) Int. Cl.[7] ..... G10H 3/00

(52) U.S. Cl. ..... 84/723; 84/600; 84/602; 84/725; 84/730

(58) Field of Search ..... 84/600–603, 622–626, 84/723–727, 730–731, 735–737, DIG. 9, DIG. 24

(56) References Cited

U.S. PATENT DOCUMENTS

| | | | | |
|---|---|---|---|---|
| 5,308,916 A | * | 5/1994 | Murata et al. | 84/603 |
| 5,367,120 A | | 11/1994 | Hoshiai | |
| 5,541,354 A | * | 7/1996 | Farrett et al. | 84/603 |
| 5,731,533 A | | 3/1998 | Hoshiai | |
| 5,789,689 A | | 8/1998 | Doidic et al. | |
| 6,111,186 A | | 8/2000 | Krozack et al. | |
| 6,448,488 B1 | * | 9/2002 | Ekhaus et al. | 84/735 |
| 6,610,917 B2 | * | 8/2003 | Ludwig | 84/726 |
| 2003/0000370 A1 | | 1/2003 | Kuroki | |

OTHER PUBLICATIONS

M. Karjalainen, H. Penttinen & V. Valmaki, More acoustic sounding timbre from guitar pickups; Proceedings of the 2nd COST G 6 Workshop on Digital Audio Effects (DAF×99), NTNU, Trodheim, Dec. 9–11, 1999.

* cited by examiner

*Primary Examiner*—Marlon T. Fletcher
(74) *Attorney, Agent, or Firm*—Blakely, Sokoloff, Taylor & Zafman, LLP

(57) ABSTRACT

Disclosed is a stringed instrument with embedded digital signal processing (DSP) modeling capabilities. The stringed instrument has a body and a plurality of strings and each of the plurality of strings is respectively coupled to a pickup of a polyphonic pickup. The polyphonic pickup is used to detect a vibration signal for each string. An A/D converter converts the detected vibration signal of a string into a digital string vibration signal. Further, a digital signal processor is located within the body of the stringed instrument to process the digital string vibration signal. Particularly, the digital signal processor is used to process the digital string vibration signal such that the corresponding string tone of one of a plurality of selectable stringed instruments may be emulated. The emulated digital tone signal is then converted to analog form to create an emulated analog tone signal for output to an amplification device.

45 Claims, 7 Drawing Sheets

STRINGED INSTRUMENT WITH EMBEDDED DSP MODELING

BACKGROUND

1. Field of the Invention

This invention relates to stringed musical instruments. In particular, the invention relates to a stringed musical instrument with embedded digital signal processing (DSP) modeling capabilities.

2. Description of Related Art

Stringed instruments utilize vibrating strings to generate tones, and therefore music, since notes of music are merely particular tones. More particularly, a tone or note is a sound that repeats at a certain specific frequency. Throughout the world, various cultures have created a multitude of different stringed instruments such as: guitars, mandolins, banjos, basses, violins, sitars, ukuleles, etc., to create music. Moreover, with the advent of electronics, many of these stringed instruments have now been electrified to operate in conjunction with an amplifier and speaker. One of the most common stringed instruments in use today is the guitar—in both its electric and acoustic forms. The guitar is one of the most popular musical instruments in use today, and it spans a huge range of musical styles—e.g. rock, country, jazz, folk, etc.

As previously discussed, the vibrating string of a stringed instrument generates a musical tone or note, which is in turn a function of: the length of the string; the amount of tension on the string; the weight of the string; the shape and thickness of the body of the stringed instrument, etc. Generally, stringed instruments, and the guitar in particular, include a body having a bridge to which each of the strings are respectively mounted, a neck having frets and a nut or 'zero' fret, and a head having tuning pegs to which each of the strings are also respectively mounted. The length of the string is the distance between the bridge and the nut or 'zero' fret. The amount of tension on the string is determined by the winding of the tuning peg which tightens and loosens the string (i.e. imparting tension) in order to tune the string to a certain note. In playing a stringed instrument, when a musician presses down on a string at a fret, the length of the string is changed and therefore its frequency is changed as well. The frets are spaced out so that the proper frequencies are produced when a string is held down at a given fret (and therefore the proper note is produced). However, it should be appreciated that not all stringed instruments have frets.

Looking at electrical stringed instruments, and utilizing an electric guitar as a particular example, to produce sound an electric guitar electronically senses the vibration of a string and generates an associated electrical signal and then routes the associated electric signal to an amplifier. The sensing generally occurs by utilizing electromagnetic pickups mounted under each of the strings of the guitar, respectively, in the guitars' body and neck, at different locations. These electromagnetic pickups typically consist of a bar magnet wrapped with a coil of thousands of turns of fine wire. The vibrating steel strings of the electric guitar produce a corresponding vibration in the magnetic field of the electromagnetic pickup and therefore a current in the coil. This current represents the sound of the string at the location of the pickup and can be routed to an amplifier. Many electric guitars have two or three different magnetic pickups located at different points of the body and neck. Each magnetic pickup will have a distinctive sound, and multiple pickups can be paired, either in-phase or out, to produce additional variations. Thus, the electromagnetic pickup locations for particular types of electric guitars are a major factor in determining the "sound" associated with the particular electric guitar along with other factors. For example, classic "sounds" are associated with various types of GIBSON and FENDER brand electric guitars, as well as others.

In order to achieve a diverse array of well-known or classic types of guitar tones, a guitarist has traditionally been required to use many different guitars. Previous attempts have been made to allow a guitarist to obtain many different classic guitar sounds utilizing only one guitar, however, these attempts generally require modification of the guitar, non-standard guitar cabling, and extra equipment. For example, previous attempts have been made to emulate the different sounds of various guitars by processing the individual strings of a guitar by means of a multi-phonic pickup attached to a standard electric guitar that delivers string vibration signals to a separate outboard processing unit that utilizes digital signal processing (DSP) techniques. The processing unit performs DSP algorithms on the string vibration signal to simulate the sound of a particular well-known guitar. Unfortunately, this requires modification to the standard electric guitar, the use of non-standard guitar cables, and the use of a detached processing unit away from the guitar, between the guitar and the amplification system.

Moreover, previous DSP techniques, which are utilized to emulate the locations of the electromagnetic pickups along the string for the desired electric guitar to be emulated, are inadequate. This is because these DSP algorithms only emulate the electromagnetic pickups in one-dimension, in the horizontal 'x' axis along the length of the string utilizing simplistic modeling techniques. Further, the simplistic algorithms utilized completely ignore a critical aspect of the tone produced by an electromagnetic pickup, which is its distance from the string in the vertical or 'y' axis, referred to as the "pickup height". Thus, previous modeling techniques are insufficient to truly emulate the overall tone of the guitar in response to a string vibration signal, and therefore cannot truly emulate the sound of the desired classic electric guitar, or any desired electric string instrument to be emulated for that matter.

SUMMARY OF THE INVENTION

Embodiments of the invention relate to a stringed instrument with embedded digital signal processing (DSP) modeling capabilities. In one embodiment, the stringed instrument has a body and a plurality of strings. Each of the plurality of strings is respectively coupled to a pickup of a polyphonic bridge pickup. The polyphonic bridge pickup is used to detect a vibration signal for each string (e.g. when a string is played by a musician). An analog to digital converter converts the detected vibration signal of a string into a digital string vibration signal. Further, a digital signal processor is located within the body of the stringed instrument to process the digital string vibration signal. Particularly, the digital signal processor is used to process the digital string vibration signal such that the corresponding string tone of one of a plurality of selectable stringed instruments may be emulated. The emulated digital tone signal may then be converted to analog form to create an emulated analog tone signal for output to an amplification device. In one embodiment, a desired string instrument can be selected by a user from a plurality of different types of stringed instruments, which can then be emulated. Further, in one embodiment of the invention, one aspect of the emulation of the corresponding string tone of the selected stringed instrument is achieved utilizing a finite impulse response (FIR) filter.

In some embodiments of the invention, a user interface is located on the body of the stringed instrument in order to allow a user to select one of a plurality of selectable stringed instruments that can be emulated. A control processor may be coupled to the user interface to provide modeling coefficients from a memory to the digital signal processor for the particular stringed instrument selected by the user. Further, in one embodiment of the invention, a plurality of different types of guitar are selectable by the user.

Embodiments of the invention further provide for emulating the pickup height of an electromagnetic pickup (e.g. along the vertical or 'y' axis) for the corresponding string of an emulated electric guitar, as well as emulating the pickup location or placement (distance from the bridge) along the x-axis for the corresponding string of an emulated electric guitar. In this way, the overall tone of the electric guitar in response to a string vibration signal is emulated along both the 'x' and 'y' axis, and thus the sound of a selected electric guitar can be truly emulated. However, it should be appreciated that the 'x' and 'y' axis calculations can be determined for any type of electric string instrument in order to more accurately emulate the stringed instrument tone. Moreover, because the digital signal processor is contained within the stringed instrument, e.g. a guitar, extra equipment such as detached processing units for DSP processing, in between the guitar and the amplifier are not necessary, and further a standard guitar cable can be used. Thus, embodiments of the invention provide a much simpler and more accurate solution to emulating stringed instruments than in the past.

BRIEF DESCRIPTION OF THE DRAWINGS

The features and advantages of the present invention will become apparent from the following description of the present invention in which.

DETAILED DESCRIPTION

In the following description, the various embodiments of the present invention will be described in detail. However, such details are included to facilitate understanding of the invention and to describe exemplary embodiments for implementing the invention. Such details should not be used to limit the invention to the particular embodiments described because other variations and embodiments are possible while staying within the scope of the invention. Furthermore, although numerous details are set forth in order to provide a thorough understanding of the present invention, it will be apparent to one skilled in the art that these specific details are not required in order to practice the present invention. In other instances details such as, well-known methods, types of data, protocols, procedures, components, processes, interfaces, electrical structures, circuits, etc. are not described in detail, or are shown in block diagram form, in order not to obscure the present invention. Furthermore, aspects of the invention will be described in particular embodiments but may be implemented in hardware, software, firmware, middleware, or a combination thereof.

Figure 1:
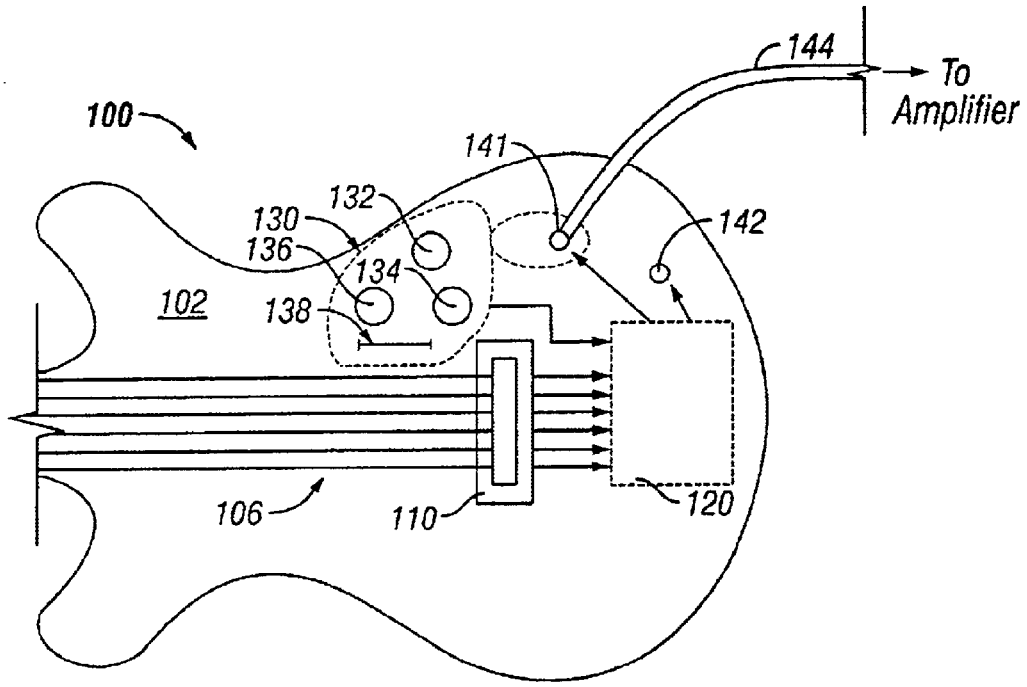
FIG. 1 is a front view of a stringed instrument with embedded digital signal processing (DSP) modeling capabilities, according to one embodiment of the present invention.

Embodiments of the invention relate to a stringed instrument with embedded digital signal processing (DSP) modeling capabilities. With reference to FIG. 1, FIG. 1 is a front view of a stringed instrument 100 with embedded digital signal processing (DSP) modeling capabilities, according to one embodiment of the present invention. The stringed instrument 100 has a body 102 and a plurality of strings 106. In this embodiment, the stringed instrument 100 has six strings and is a guitar. However, it should be appreciated that the stringed instrument 100 may be any type of stringed instrument (e.g. mandolin, banjo, bass, violin, sitar, ukulele, etc.).

Each of the plurality of strings is respectively coupled to a pickup of a polyphonic bridge pickup 110. The polyphonic bridge pickup 110 is used to detect a vibration signal for each string 106 (e.g. when a string is played by a musician). In the example shown, the polyphonic bridge 110 is a hexaphonic bridge to accommodate the six strings 106. The polyphonic bridge 110 may be a piezoelectric type of bridge to detect the vibration signal for each string or any other type of suitable sensor to detect the vibration signal for each string. The sensor also need not be integrated in the bridge assembly. A polyphonic magnetic or optical pickup that is not attached to the bridge could also be used. Moreover, in other embodiments, the polyphonic pickup may be of any suitable size to accommodate any number of strings for the desired stringed instrument to be emulated.

Also, as will be discussed, an analog to digital converter converts the detected vibration signal of a string 106 from the polyphonic bridge 100 into a digital string vibration signal, which is passed on to a digital signal processor 120 for processing. The digital signal processor 120 is located within the body 102 of the stringed instrument 100 to process the digital string vibration signal. Particularly, the digital signal processor 120 is used to process the digital string vibration signal such that the corresponding string tone of one of a plurality of selectable stringed instruments may be emulated. In one embodiment of the invention, the emulation of the corresponding string tone of the selected stringed instrument is achieved utilizing a finite impulse response (FIR) filter, as will be discussed. The emulated digital tone signal can then be converted to analog form to create an emulated analog tone signal for output to an amplification device.

Embodiments of the invention allow for desired string instrument to be selected by a user and then emulated. Particularly, a user interface 130 may be located on the body 102 of the stringed instrument 100 in order to allow a user to select one of a plurality of different types of stringed instruments that can be emulated. As will be discussed, a control processor may be coupled to the user interface to provide modeling coefficients from a memory to the digital signal processor 120 for the particular stringed instrument selected by the user to be emulated.

Further, in the guitar embodiment of the invention (i.e. where the stringed instrument 100 is a guitar), a plurality of different types of guitar are selectable by the user. For example, classic types of guitars that have associated classic "sounds" or tones that may be emulated including various types of GIBSON and FENDER brand electric guitars, various types of acoustic guitars (e.g. steel or nylon string), as well as others.

The stringed instrument 100 will hereinafter be referred to as guitar 100, in order to illustrate one embodiment of the invention and in order to simplify the explanation of the principles of the invention. However, it should be appreciated that this is only for illustrative purposes and the principles of the invention can be applied to any stringed instrument (e.g. mandolin, banjo, bass, violin, sitar, ukulele, etc.).

One advantage of the invention is that because the digital signal processor 120 is contained within the guitar 100, extra equipment such as detached processing units for DSP processing in between the guitar and the amplifier are not necessary. The guitar 100 with embedded DSP modeling capabilities also has a first output jack 141 and an optional second output jack 142 for output of the emulated analog vibration signal. Further, a standard cable 144 can be used to route the emulated analog vibration signal (i.e. the sound) of the emulated guitar to an amplification system such as an amplifier. Thus, embodiments of the invention provide a much simpler and more accurate solution to emulating stringed instruments, such as guitars, than in the past.

Returning again to the user interface 130 of the guitar 100, in one embodiment, the user interface 130 is located on the body of the guitar and includes a volume knob 132 to adjust the volume of the guitar 100, a tone knob 134 to adjust the tone of the guitar 100, and a guitar selector knob 136 to select the type of guitar to be emulated. For example, the guitar selector knob 136 can be moved to a plurality of different positions to choose a plurality of different types of guitars to be emulated. As one example, the guitar selector knob can be moved to a plurality of different positions to select a variety of different types of GIBSON brand electric guitars, a variety of different types of FENDER brand electric guitars, a variety of different types of acoustic guitars (steel or nylon string), as well as other types of guitars or even other types of stringed instruments.

Moreover, the user interface 130 includes a blade switch which can be utilized as an emulated pickup selector to select emulated pickups (e.g. rhythm, treble, standard, etc.) for the selected emulated guitar chosen by the guitar selector knob 136. Furthermore, the blade switch 138 can be utilized in conjunction with the guitar selector knob 136 to generate a wide variety of different emulated guitar tones such as by providing further emulated pickup configurations, different wiring, or just entirely different types of emulated guitar or other stringed instrument tones. It should be appreciated that although a particular user interface 130 has been described with reference to FIG. 1, a wide variety of different types of user interfaces including LCDs, graphic displays, touch-screens, alphanumeric entry keys, etc., can be used to perform the functions of the guitar selector knob, the blade switch, the tone knob, and the volume knob and other functions associated with embodiments of the invention.

Figure 2:
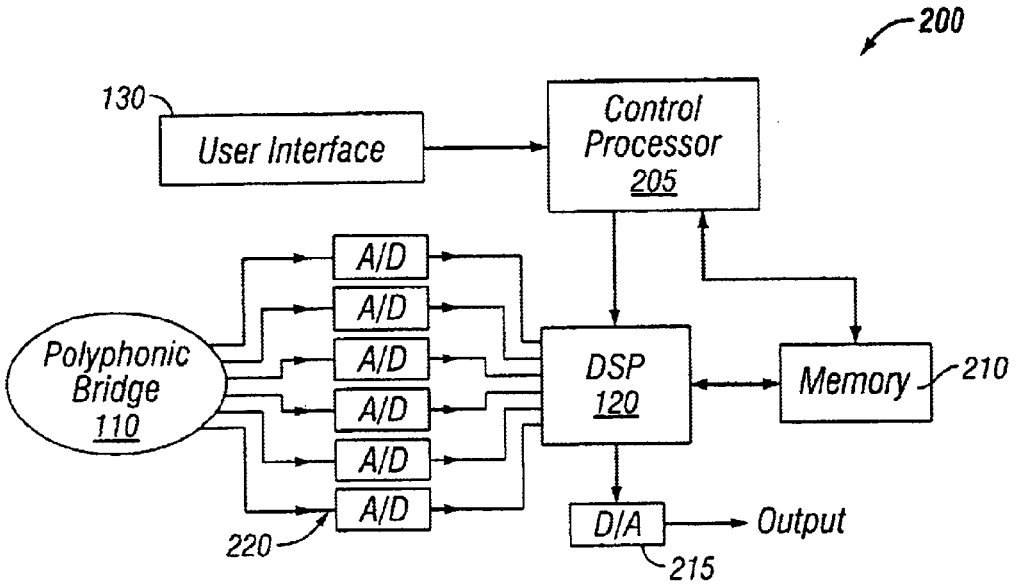
FIG. 2 is a block diagram illustrating the functional blocks of the stringed instrument with embedded digital signal processing (DSP) modeling capabilities, according to one embodiment of the present invention.

Turning now to FIG. 2, FIG. 2 is a block diagram illustrating the functional blocks 200 of a stringed instrument with embedded digital signal processing (DSP) modeling capabilities, e.g. guitar 100, according to one embodiment of the present invention. As shown in FIG. 2, the functional blocks 200 include the user interface 130 (previously discussed), a control processor 205, digital signal processor 120, memory 210, digital to analog (D/A) converter 215, and a plurality of analog to digital (A/D) converters 220. The polyphonic pickup 110 is coupled to the plurality of A/D converters 220 and the A/D converters 220 are each respectively coupled to digital signal processor 120. In this example, there are six A/D converters, one for each string of the guitar. As previously discussed, the polyphonic pickup 110 is used to detect a vibration signal for each string (e.g. when a string is played by a musician). The detected vibration signal for the signal for the string is then coupled to a respective A/D converter 220. The respective A/D converter 220 converts the detected vibration signal of the string into a digital string vibration signal and couples the digital string vibration signal to the digital signal processor 120.

The digital signal processor 120 then processes the digital string vibration signal. As previously discussed, the user interface 130 allows a user to select one of a plurality of different types of guitars that can be emulated. Particularly, the digital signal processor 120 is used to process the digital string vibration signal such that the corresponding string of the selected guitar is properly emulated based on modeling coefficients for the selected guitar stored in memory 210. The user interface 130 is coupled to the digital signal processor 120 by the control processor 205. Also, memory 210 can be directly coupled to digital signal processor 120.

The control processor 205 provides the proper modeling coefficients from memory 210 to the digital signal processor 120 for the particular guitar selected by the user. In this way, the digital signal processor 120 performs the proper transformations on the digital string vibration signal to properly emulate the corresponding string tone of the particular guitar chosen by the user as it is played. Although the control processor 205 is shown as a separate circuit, it should be appreciated that the functionality of the control processor can instead be performed by the digital signal processor 120, in other embodiments. As will be discussed, in one embodiment of the invention, one aspect of the emulation of the corresponding string of the selected guitar is achieved utilizing a finite impulse response (FIR) filter. The emulated digital tone signal is then converted to analog form by D/A converter 215 to create an emulated analog tone signal for output to an amplification device. For example, the emulated analog vibration signal can be transmitted from the guitar 100 to an amplifier (not shown) utilizing a standard guitar cable.

The control processor 205 may be any sort of suitable processor or microprocessor to process information in order to implement the functions of the embodiments of the invention. As illustrative examples, the "processor" may include a processor having any type of architecture such as complex instruction set computers (CISC), reduced instruction set computers (RISC), very long instruction word (VLIW), or hybrid architecture, a microcontroller, a state machine, etc. Further, the digital signal processor 120 may be any suitable general DSP processing chip in order to implement the digital signal processing functions of the embodiments of the invention, as will be discussed. Examples of suitable DSP processing chips include chips produced by MOTOROLA, SHARP, TEXAS INSTRUMENTS, etc.

The memory 210 may include various types of flash programmable memory, non-volatile memory, and volatile memory, etc. Memory 210 is capable of storing data as well as instructions to be executed by processor 205 and may be used to store temporary variables (e.g. audio data, calculated parameters, etc.) or other intermediate information during execution of instructions by control processor 205 and digital signal processor 120. Non-volatile memory may be used for storing static information (e.g. particular FIR filters, modeling coefficients, other parameters, etc.) and instructions for control processor 205 and digital signal processor 120. Examples of non-volatile memory include ROM type memories and/or other static storage devices such as hard disk, flash memory, battery-backed random access memory, and the like, whereas volatile main memory 222 includes random access memory (RAM), dynamic random access memory (DRAM) or static random access memory (SRAM), and the like.

In continuing with this example, the control processor 205 and digital signal processor 120 may operate under the control of software or firmware modules that are booted into memory for execution when the guitar 100 is powered-on or reset. These software or firmware modules typically include programs that allow for the selection of a desired guitar to be emulated by the user and further control the selection and implementation of the correct modeling coefficients for digital signal processing on input digital vibration signals (e.g. to implement FIR filters) such that the desired guitar sounds are properly emulated, and other DSP functions related to embodiments of the invention, as will be discussed.

These functions can be implemented as one or more instructions (e.g. code segments), to perform the desired functions or operations of the invention. When implemented in software (e.g. by a software or firmware module), the elements of the present invention are the instructions/code segments to perform the necessary tasks. The instructions which when read and executed by a machine or processor (e.g. processor 205), cause the machine or processor to perform the operations necessary to implement and/or use embodiments of the invention. The instructions or code segments can be stored in a machine readable medium (e.g. a processor readable medium or a computer program product), or transmitted by a computer data signal embodied in a carrier wave, or a signal modulated by a carrier, over a transmission medium or communication link. The machine-readable medium may include any medium that can store or transfer information in a form readable and executable by a machine (e.g. a processor, a computer, etc.). Examples of the machine readable medium include an electronic circuit, a semiconductor memory device, a ROM, a flash memory, an erasable programmable ROM (EPROM), a floppy diskette, a compact disk CD-ROM, an optical disk, a hard disk, a fiber optic medium, a radio frequency (RF) link, etc. The computer data signal may include any signal that can propagate over a transmission medium such as electronic network channels, optical fibers, air, electromagnetic, RF links, etc. The code segments may be downloaded via networks such as the Internet, Intranet, etc.

Moreover, the emulated digital tone signal may undergo further digital signal processing to emulate one of a plurality of amplifier and speaker cabinet setups before being converted to an analog vibration signal and transmitted to a real amplifier. Existing software modules can be utilized to digitally process the emulated digital tone signal for the selected guitar such that it is processed to sound as if it is being played through one of a plurality of different amplifier and cabinet setups. Examples of common amplifier and cabinet setups are those produced by MARSHALL, FENDER, VOX, ROLAND, etc.

In particular, it should be appreciated that DSP algorithms for digitally processing the emulated digital tone signal for the selected guitar such that it is processed to sound as if it is being played through one of a plurality of different amplifier and cabinet setups are known in the art and can be easily implemented by an appropriate software module in conjunction with control processor 205 and digital signal processor 120. One example of DSP algorithms for altering the digital guitar signals to model various amplifiers and speaker cabinet configurations which may be used is particularly described in U.S. Pat. No. 5,789,689 entitled "Tube Modeling Programmable Digital Guitar Amplification System", which is hereby incorporated by reference. Moreover, other software modules used in LINE6 products such as in AMP FARM and POD products may also be utilized.

Figure 3:
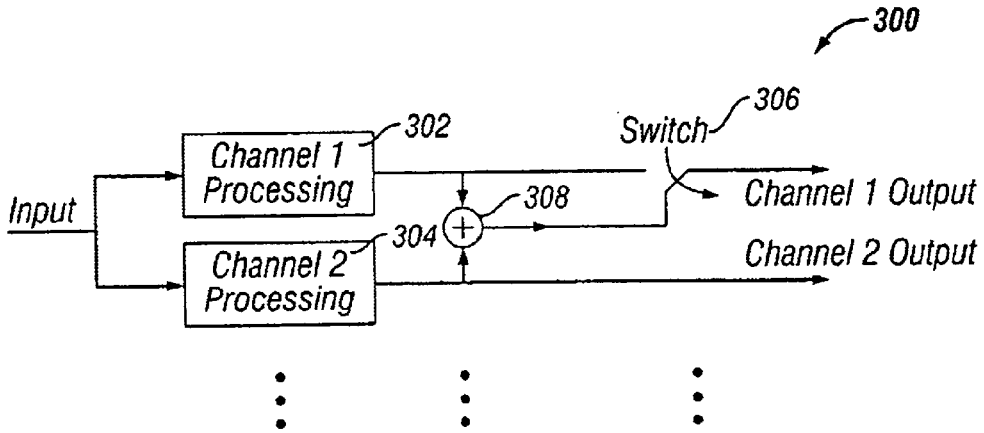
FIG. 3 is a block diagram illustrating multiple emulated stringed instruments being combined such that they can be played simultaneously, according to one embodiment of the present invention.

With reference now to FIG. 3, FIG. 3 is a block diagram 300 illustrating multiple emulated stringed instruments, e.g. guitars, being combined such that they are played simultaneously, according to one embodiment of the present invention. Particularly, as shown in FIG. 3, an input vibration signal of the string detected by the polyphonic bridge is inputted into a plurality of processing channels, where each channel processes a different emulated stringed instrument. This simultaneous processing can be achieved by one DSP (instance 120 of FIG. 2) which performs parallel processing of the input to emulate different stringed instruments, or alternatively inputted into a plurality of DSP instances processing a different type of emulated stringed instrument (e.g. different types of guitars) for a given digital string input vibration signal (i.e. from the played string).

As previously discussed, in the guitar embodiment, typically only one type of guitar for a given digital string input vibration signal is emulated at a time. However, embodiments of the invention provide for multiple guitars being emulated simultaneously for the given played string vibration signal to give a much more diverse range of sounds. In this embodiment, a switch 306 can be activated such that the emulated guitar signals are combined by adder 308 and outputted along channel 1 output. Then the combined emulated guitar signals can be converted to analog form and outputted for amplification, as previously discussed. On the other hand, when switch 306 is not activated the channels are kept separated for output to independent channels. It should be appreciated that any number of channel processing units, adders, and switches can be used to combine a multitude of different emulated stringed instrument and guitar sounds together, simultaneously, to create a much more diverse range of sound. Further, the user interface 130 may allow a user to select a multitude of different guitars and other types of stringed instruments to be selected and played simultaneously.

Details of some of the DSP algorithms for a stringed instrument (e.g. guitar) with embedded digital signal processing (DSP) modeling capabilities of the present invention will now be discussed. Particularly, finite impulse response (FIR) filters, system block diagrams, and other charts will be discussed to show how some aspects of the string tone of an electric stringed instrument, such as a guitar 100, is properly modeled in order to provide a stringed instrument that can properly emulate a plurality of different types of electric stringed instruments. As previously discussed, the invention is also capable of emulated acoustic stringed instruments. The following discussion will refer to a guitar string for guitar, however, as previously discussed the DSP modeling can apply to any string of any stringed instrument. In one embodiment of the invention, the emulation of one aspect of the corresponding string tone of the selected guitar is achieved utilizing a finite impulse response (FIR) filter, as will be discussed. Moreover, embodiments of the invention further provide for emulating the pickup height of an electromagnetic pickup (e.g. along the vertical or 'y' axis) for the corresponding string of the emulated guitar, as well as emulating the guitar string's response along the x-axis. In this way, the overall tone of the guitar in response to a string vibration signal detected by an electromagnetic pickup at a particular location relative to the string is emulated along both the 'x' and 'y' axis, and thus the sound of a desired guitar can be truly emulated. However, it should be appreciated that the 'x' and 'y' axis calculations can be determined for any type of electrified string instrument in order to more accurately emulate the stringed instrument.

Figure 4:
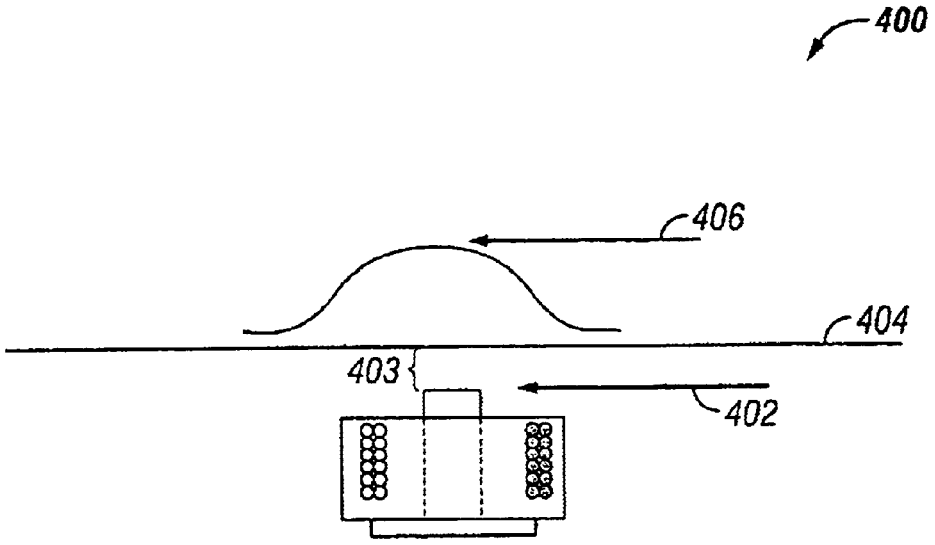
FIG. 4 shows an electromagnetic pickup located relatively distant (i.e. having a relatively large pickup height) from a guitar string and the resulting magnetic aperture.
Figure 5:
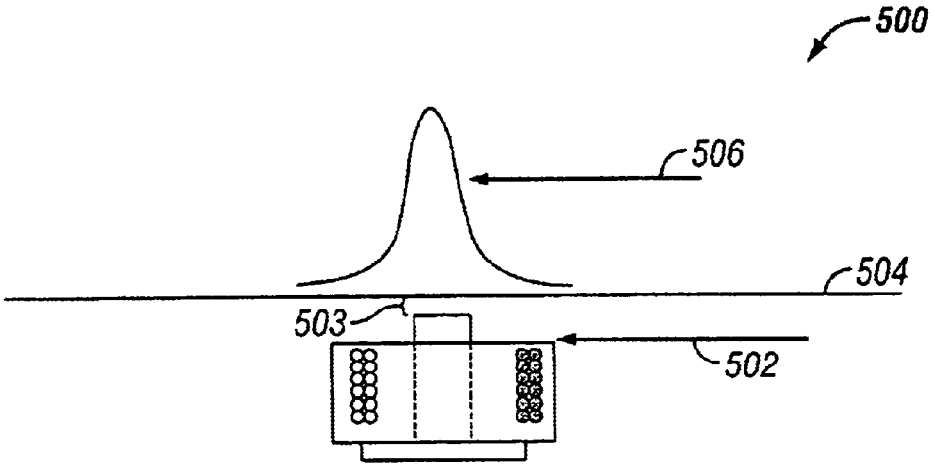
FIG. 5 shows an electromagnetic pickup located relatively close (i.e. having a relatively small pickup height) from a guitar string and the resulting magnetic aperture.

But first, a discussion will be provided to discuss how the pickup height of an electromagnetic pickup of an electric guitar affects the shape of the magnetic aperture of the string, which directly affects the tone of the string of the guitar. Turning now to FIG. 4, FIG. 4 shows an electromagnetic pickup 402 (e.g. located in the body or neck of a guitar) located relatively distant (i.e. having a relatively large pickup height 403) from a guitar string 404 and the resulting magnetic aperture 406. The strength of the magnetic field along the length of the string, is known as the "magnetic aperture" or "sensing window" of the electromagnetic pickup. The magnetic aperture is directly dependent on the pickup height 403. As depicted in FIG. 4, when the electromagnetic pickup 402 is relatively distant from the guitar string the shape of the magnetic aperture 406 is broad with a lower amplitude. On the other hand, looking to FIG. 5, FIG. 5 shows an electromagnetic pickup 502 located relatively close (i.e. having a relatively small pickup height 503) from a guitar string 504 and the resulting magnetic aperture 506. As shown in FIG. 5, a relatively small pickup height 503 results in a magnetic aperture 506 that is narrower with a higher amplitude. Also, depending on the pickup configuration, the magnetic aperture need not be symmetrical.

The second way that the pickup height affects the tone of a guitar string of a guitar is in the degree of non-linearity of the output signal in response to a string vibration signal. The magnetic field strength in the vertical axis or 'y' axis is strongest right above the electromagnetic pickup, and it is weaker as the vertical distance increases. Therefore, when a string is played, the string's oscillation brings the string closer to and farther from the electromagnetic pickup such that a nonlinear gain needs to be applied to model the non-linear distortion associated with the pickup height of the electromagnetic pickup and to therefore properly model or emulate the true sound of the guitar string. Of course, depending on the pickup height, the amount of non-linearity will vary. This will be discussed in more detail later.

Discussion will now proceed as to how a guitar string of a particular guitar with a certain configuration of electromagnetic pickups is modeled to generate an appropriate digital system characterization for implementation by digital signal processing (DSP), and particularly by the stringed instrument (e.g. guitar) with embedded digital signal processing (DSP) modeling capabilities according to embodiments of the present invention. Particularly, modeling coefficients for finite impulse response (FIR) filters can be determined by the process to be described hereinafter for a plurality of different guitars and other stringed instruments such that plurality of different guitars and other stringed instruments can be digitally emulated and offered as choices to a user.

Figure 6:
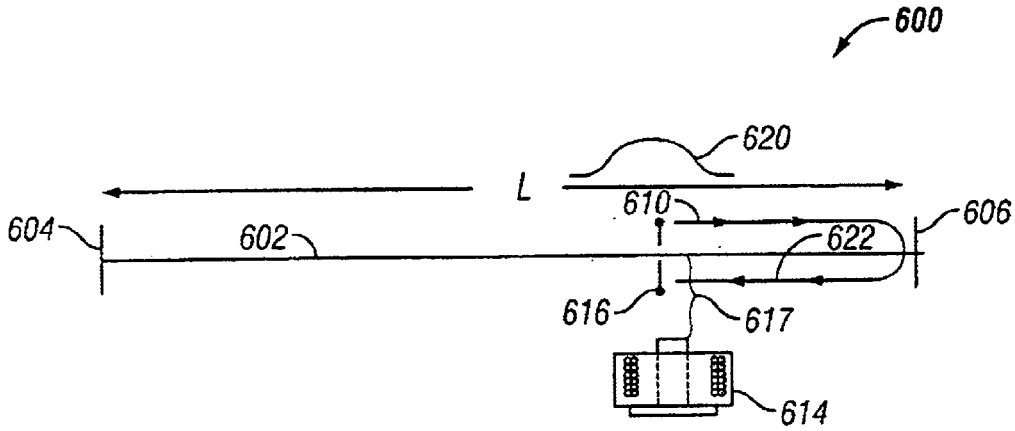
FIG. 6 shows a diagram illustrating a process for digitally modeling a magnetic aperture of a guitar string of a particular guitar having an electromagnetic pickup at a particular location, according to one embodiment of the present invention.

Turning now to FIG. 6, FIG. 6 shows a diagram illustrating a process 600 for digitally modeling a magnetic aperture of a guitar string of a particular guitar with an electromagnetic pickup at a particular location. As shown in FIG. 6, a guitar string 602 is coupled between a tuning nut 604 and a bridge 606 and has a length L. An initial impulse wave 610 travels along the guitar string 602 with an electromagnetic pickup 614 underneath the string at a distance x 616 from the bridge 606. Further, the electromagnetic pickup 614 has a corresponding pickup height y 617. The shape of the magnetic aperture 620 becomes the shape of the electromagnetic pickup output in response to the initial impulse wave 610. When the initial impulse wave 610 reaches the bridge 606, the impulse wave is inverted becoming the reflected impulse wave 622 and travels back along the guitar string 602 in the opposite direction, with a corresponding response that is inverted and mirrored from the response in the forward direction. Thus, a total impulse response can be calculated to be a summation of the initial impulse wave 610 and the reflected impulse wave 622 responses.

The time delay between these two responses is the time it takes the initial impulse wave 610 to travel a distance of 2*x. This can be calculated as:

$$\tau = \frac{x}{L \cdot f_0}$$

where $f_0$ is the guitar string's open frequency.

In a sampled or digital system, this time delay is achieved by a delay of N samples such that:

$$N = \frac{x \cdot f_s}{L \cdot f_0}$$

where fs is the time sampling frequency of the system.

Figure 7:
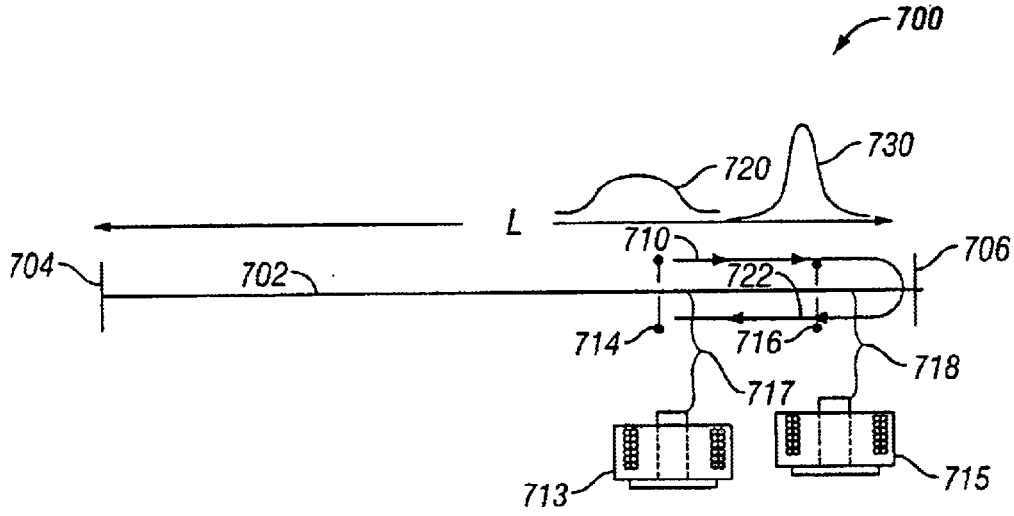
FIG. 7 shows a diagram illustrating process for the digitally modeling magnetic apertures for a guitar string of a particular guitar with a first electromagnetic pickup at a first location and a second electromagnetic pickup at a second location, according to one embodiment of the present invention.

Turning now to FIG. 7, FIG. 7 shows a diagram illustrating a process 700 for digitally modeling magnetic apertures for a guitar string of a particular guitar with a first electromagnetic pickup at a first location and a second electromagnetic pickup at a second location. As shown in FIG. 7, a guitar string 702 is coupled between a tuning nut 704 and a bridge 706 and has a length L. An initial impulse wave 710 travels along the guitar string 702 with a first electromagnetic pickup 713 underneath the string at a distance x1 714 from the bridge 706 and a second electromagnetic pickup 715 underneath the string at a distance x2 716 from the bridge 706. Further, the first electromagnetic pickup 713 has a corresponding pickup height y1 717 and the second electromagnetic pickup 715 has a corresponding pickup height y2 718.

The shape of the first magnetic aperture 720 becomes the shape of the output of the first electromagnetic pickup 713 in response to the initial impulse wave 710. Again, when the initial impulse wave 710 reaches the bridge 706, the impulse wave is inverted becoming the reflected impulse wave 722 and travels back along the guitar string 702 in the opposite direction, with a corresponding response that is inverted and mirrored from the response in the forward direction. Thus, a total impulse response for the first magnetic aperture 720 for the first electromagnetic pickup 713 can be calculated to be a summation of the initial impulse wave 710 and the reflected impulse wave 722 responses for the first electromagnetic pickup 713.

Similarly, the shape of the second magnetic aperture 730 becomes the shape of the output of the second electromagnetic pickup 715 in response to the initial impulse wave 710. Again, when the initial impulse wave 710 reaches the bridge 706, the impulse wave is inverted becoming the reflected impulse wave 722 and travels back along the guitar string 702 in the opposite direction, with a corresponding response that is inverted and mirrored from the response in the forward direction. Thus, a total impulse response for the second magnetic aperture 730 for the second electromagnetic pickup 715 can be calculated to be a summation of the initial impulse wave 710 and the reflected impulse wave 722 responses for the second electromagnetic pickup 715.

Further, in the case of multiple electromagnetic pickups 713 and 715 sensing the string vibration signal, N (the delay) is computed in the same way for each electromagnetic pickup. Also, it should be noted that the response of the second electromagnetic pickup 715 is closer to the bridge and is therefore delayed relative to response of the first electromagnetic pickup 713 farthest from the bridge. The delay D between the responses is calculated based on the same principles of wave velocity and distance and leads to the general solution for n electromagnetic pickups:

$$N_n = \frac{X_n \cdot f_s}{L \cdot f_0};\ D_n = \frac{(N_1 - N_n)}{2};\ n = 1, 2, 3 \ldots$$

The magnetic apertures 720 and 730 can be represented as finite impulse response (FIR) filters, respectively, whose coefficients are the measured field strength along the string, sampled at a distance interval, d, determined by the wave velocity $f_0$, the time-sampling frequency $f_s$, and the length of the string, L.

$$d = 2 \cdot L \cdot f_0 / f_s$$

As is known in the art, FIR filters have the mathematical form $y_n = h_0x_0 + h_1x_1 + h_2x_2 + \ldots h_Nx_N$; where $h_n$ are fixed filter coefficients from 0 to N, and $x_0$ to $x_N$ are the data samples (in this case the sampled digital string vibration signals from the polyphonic bridge). By performing the above process 700 to calculate the impulse responses for the electromagnetic pickups 713 and 715 all of the fixed $h_n$ modeling coefficients can be calculated and a digital transfer function can be calculated for the guitar string of the desired guitar to be emulated. The coefficients for each string of each selectable guitar or other stringed instrument can be stored in the memory 210 of the guitar with embedded DSP modeling capabilities 100. Also, it should be appreciated that when the inverted impulse travels back along the string, the modeling coefficients are mirrored about the center. Thus, the same coefficients can be read in reverse order, eliminating the need for extra storage space for the inverted impulse filter. Accordingly, tables of modeling coefficients that represent the magnetic aperture for various configurations of electromagnetic pickups having various pickup heights (y-axis) can be stored in memory to effectively emulate each string of a multitude of different types of guitars (e.g. electric, acoustic, etc.), as well as other stringed instruments for selection by a user.

Figure 8:
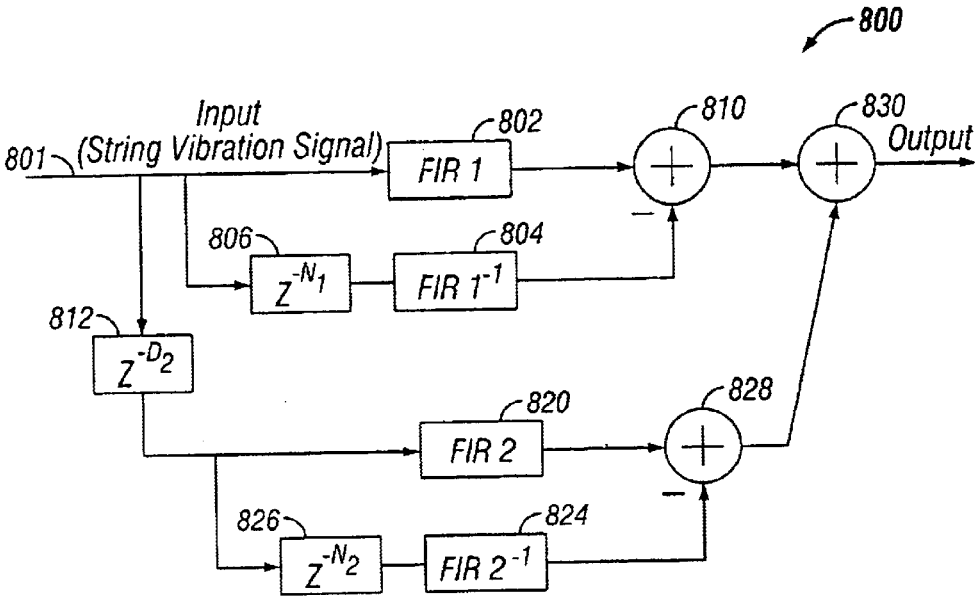
FIG. 8 shows an example of a block diagram of a generalized DSP algorithm for emulating the guitar that was previously modeled having two electromagnetic pickups located at particular x (horizontal) locations and at particular y (pickup height) displacements along the string of the guitar (FIG. 7), wherein the resulting magnetic apertures are emulated with FR filters, according to one embodiment of the present invention.

With reference now to FIG. 8, FIG. 8 shows an example of a block diagram of a generalized DSP algorithm 800 for emulating the guitar that was previously modeled having two electromagnetic pickups 713 and 715 located at particular x (horizontal) locations and at particular y (pickup height) displacements along the string 702 of the guitar (FIG. 7), wherein the resulting magnetic apertures 720 and 730 are emulated with FIR filters. As shown in FIG. 8, an input digital string vibration signal 801 for the string enters the DSP block diagram 800. It should be appreciated that the generalized DSP block diagram is a representation of the digital transfer function for the emulation of the previously modeled guitar string 702 of the desired guitar to be emulated having the particular configuration of electromagnetic pickups 713 and 715, as previously discussed. However, it should be appreciated that this generalized DSP block can be applied to any string of any guitar having two electromagnetic pickups, or any other stringed instrument as the equations will remain the same and different values for the variables for the particular guitar or stringed instrument to be modeled can be used.

By way of illustration, the input digital string vibration signal 801 is processed by FIR1 802 emulating the magnetic aperture filter response for electromagnetic pickup 713 in response to the initial vibration signal and by $FIR1^{-1}$ 804 which is the inverse of FIR1 representing the magnetic aperture filter response for electromagnetic pickup 713 in response to the reflected vibration signal (i.e. reflected from the bridge). Further, the input digital vibration signal 801 is delayed by $z^{-N_1}$, such that the reflected vibration signal is emulated as being delayed by $N_1$ samples. Also, as is known in digital system theory $z^{-N}$ represents the sampled digitized equivalent of the true input vibration signal 801 delayed by N samples. Moreover, the initial and reflected magnetic aperture FIR responses of FIR1 802 and $FIR1^{-1}$ 804 to the input vibration signal 801 are then summed with adder 810 to generate an emulated digital string tone signal of emulated electromagnetic pickup 713.

Similarly, after the input vibration signal 801 is delayed by $z^{-D_2}$ 812 such that the response of the second electromagnetic pickup 715, which is closer to the bridge, is properly delayed relative to the response of the first electromagnetic pickup 713 farthest from the bridge, the input digital string vibration signal 801 is processed by FIR2 820 emulating the magnetic aperture filter response for electromagnetic pickup 715 in response to the initial vibration signal and by $FIR2^{-1}$ 824 which is the inverse of FIR2 representing the magnetic aperture filter response for electromagnetic pickup 715 in response to the reflected vibration signal (i.e. reflected from the bridge). Further, the delayed input vibration signal from the output of delay 812 is delayed by $z^{-N_2}$ 826 such that the reflected vibration signal is emulated as being delayed by $N_2$ samples. Moreover, the initial and reflected magnetic aperture FIR responses of FIR2 820 and $FIR2^{-1}$ 824 to the input vibration signal 801 are then summed with adder 826 to generate an emulated digital string vibration signal of emulated electromagnetic pickup 715.

Lastly, both the emulated digital string tone signal of emulated electromagnetic pickup 713 and emulated digital string tone signal of emulated electromagnetic pickup 715 are summed by adder 830 such that an emulated digital tone signal for the corresponding string of the desired guitar that the user has chosen to be emulated (which as in this example has the particular configuration of electromagnetic pickups 713 and 715) is created. This emulated digital tone signal can then be further processed by additional tone-shaping blocks or converted to analog format and outputted to an amplifier which can then playback the emulated tone such that the guitar with embedded DSP modeling capabilities 100 sound like the desired guitar chosen by the user.

Thus, a digital transfer function represented by generalized DSP block diagram 800 incorporating predetermined FIR filters having predetermined modeling coefficients, based on impulse responses of the modeled electromagnetic pickups, and calculated delays, is created. This digital transfer function can be used emulate the output signal of a guitar string for the particular guitar chosen by a user (having a given configuration of electromagnetic pickups previously modeled) in response to a digital input signal from a played string. In other words, based on a digital string vibration signal detected by the pickup, the digital signal processor 120 implementing the particular digital transfer function (with predetermined modeling coefficients) of the generalized DSP block diagram 800 can process the digital string vibration signal to emulate the corresponding string tone of a previously modeled guitar (which has a particular configuration of electromagnetic pickups (e.g. in this case two pickups)) to create an emulated digital tone signal for the played string. This emulated digital tone signal can then be converted to analog format and outputted to an amplifier which can then playback the emulated tone such that the guitar with embedded DSP modeling capabilities 100 sounds like the guitar selected by the user. It should be appreciated by those skilled in the art that the above-described DSP algorithms model pickup locations in two dimensions and that further processing is generally required to ultimately generate an output signal.

Although the previously described generalized DSP block diagram 800 shows one example of a DSP block diagram for a guitar having two electromagnetic pickups for a particular guitar string, it should be appreciated by those skilled in the art that the previously described processes and methods of characterizing the guitar string of the guitar with a particular configuration of electromagnetic pickups can be done for any guitar string of any guitar having any number of electromagnetic pickup configurations and any number of strings. Thus, any guitar, or any stringed instrument can be modeled and then emulated utilizing the previously described processes and methods.

Therefore, using embodiments of the invention, a digital transfer function incorporating predetermined FIR filters having predetermined modeling coefficients, based on impulse responses of modeled electromagnetic pickups, and calculated delays, can be created for any guitar or stringed instrument having a given configuration of electromagnetic pickups and any number of strings. Accordingly, a digital transfer function and corresponding DSP block diagram model can be created and used to emulate an output signal for any guitar or stringed instrument in response to a digital input signal from a played string. In other words, based on a digital string vibration signal detected by the bridge, the digital signal processor 120 implementing a particular digital transfer function (with predetermined modeling coefficients) can process the digital string vibration signal to emulate a corresponding string's tone of a desired guitar that the user has chosen to be emulated to create an emulated digital tone signal of the selected guitar. This emulated digital tone signal can then be converted to analog format and outputted to an amplifier which can then playback the emulated tone such that the guitar with embedded DSP modeling capabilities sounds like the desired guitar chosen by the user. Moreover, this methodology can be applied to any stringed instrument, e.g., acoustic guitars, mandolins, basses, etc.

Also, important to accurately modeling the tone of a guitar is the way the pickup height affects the tone of the guitar by introducing non-linear distortion into the output signal of the guitar in response to the string vibrating. The magnetic field strength in the vertical axis or 'y' axis is strongest right above the electromagnetic pickup, and it is weaker as the vertical distance increases. Therefore, when a string is played, the string's oscillation brings the string closer to and farther from the electromagnetic pickup such that non-linear distortion is introduced into the guitar output and therefore a nonlinear gain needs to be applied to properly model or emulate the true sound of the guitar string. Of course, depending on the pickup height, the amount of non-linearity will vary.

Embodiments of the invention further provide for emulating the pickup height of an electromagnetic pickup (e.g. along the vertical or 'y' for the axis) for the corresponding string of the emulated guitar. More particularly, emulating the pickup height of the electromagnetic pickup also includes applying a non-linear gain to model non-linear distortion associated with the pickup height of the electromagnetic pickup for the corresponding string of the emulated stringed instrument, e.g. a guitar, in the processing of the digital string vibration signal. In this way, the overall tone of the guitar in response to a string vibration signal is emulated along both the 'x' and 'y' axis, and thus the sound of a selected guitar to be emulated, can be more truly emulated.

Figure 9:
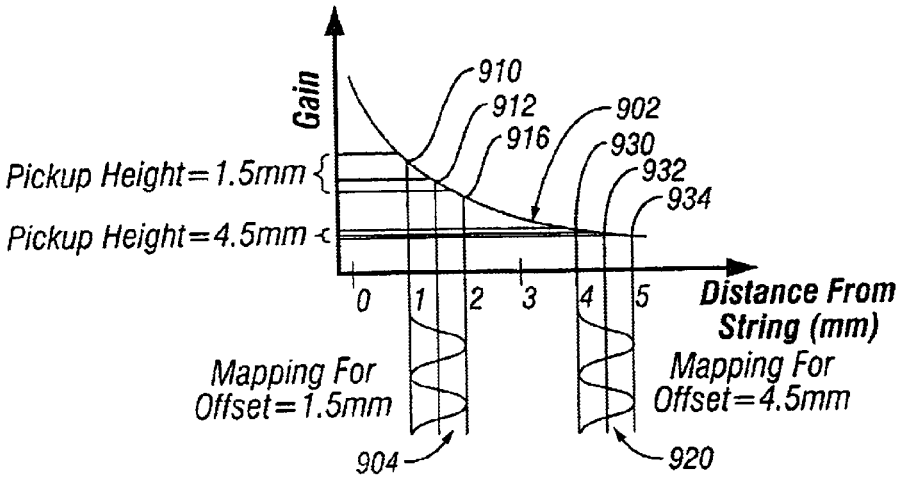
FIG. 9 shows a non-linear gain curve for different pickup heights in relation to a vibrating string, according to one embodiment of the present invention.

In order to model the non-linearity of a vibrating string with respect to differing pickup heights of an electromagnetic pickup, a string vibration signal that represents the distance traveled by a string to or from an electromagnetic pickup (along the y axis), from the at rest 'bias' point of the string, can be used with reference to a non-linear gain curve. Referring now to FIG. 9, FIG. 9 shows a non-linear gain curve 902 for different pickup heights in relation to a vibrating string. Particularly, a string vibration signal is mapped to the non-linear gain curve 902, where the maximum attainable amplitude of the string vibration signal corresponds to the maximum amount of string travel from observation. As will be discussed, an offset can then be added to the digital string vibration signal to obtain the proper gain and hence simulate the effect of the pickup height and the degree of non-linearity that is introduced due to the pickup height in relation to the vibrating string.

Figure 10A:
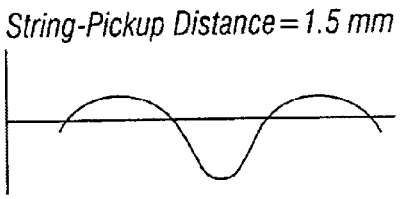
FIG. 10*a* shows an example of the distorted output of a vibrating string (e.g. output in voltage) due to non-linear gain for a first relatively close pickup height.

FIG. 9 demonstrates this effect for a sinusoidally vibrating string vibrating with an amplitude of 1 millimeter (mm) peak-to-peak over the region of a virtual electromagnetic pickup (i.e. over the pickup height, the bias point, when the string is at rest). The variable gain is shown at min, max, and mid string vibration for these two locations. As a first example, a sinusoidally vibrating string 904 is shown vibrating about a virtual electromagnetic pickup, wherein the pickup height is 1.5 mm (i.e. this is the bias point when the string is at rest) and the string vibrates between a 1 mm pickup height and a 2 mm pickup height. Correspondingly on the non-linear gain curve 902 an associated gain at a minimum 910 (i.e. pickup height=1 mm) can be found, an associated gain at middle 912 (i.e. pickup height=1.5 mm, the bias point), and an associated gain at maximum 916 (i.e. pickup height=2 mm). FIG. 10*a* shows an example of the distorted output of vibrating string 904 (e.g. output in voltage) due to non-linear gain.

Figure 10B:
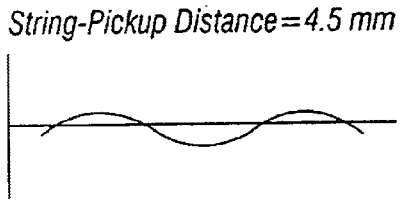
FIG. 10*b* shows the distorted output of a vibrating string (e.g. output in voltage) due to non-linear gain for a second relatively distant pickup height.

As a second example, a sinusoidally vibrating string 920 is shown vibrating about a virtual electromagnetic pickup, wherein the pickup height is 4.5 mm (i.e. this is the bias point when the string is at rest) and the string vibrates between a 4 mm pickup height and a 5 mm pickup height. Correspondingly on the non-linear gain curve 902 an associated gain at a minimum 930 (i.e. pickup height=4 mm) can be found, an associated gain at middle 932 (i.e. pickup height=4.5 mm, the bias point), and an associated gain at maximum 934 (i.e. pickup height=5 mm). FIG. 10*b* shows the distorted voltage output of vibrating string 920 (e.g. output in voltage) due to non-linear gain.

As can be seen in FIGS. 10*a* and 10*b*, the output of the same vibrating string signal gets more heavily distorted as the pickup gets closer to the string. Thus, in FIG. 10*a* where the pickup is relatively close (i.e. pickup height=1.5 mm) the output signal is more heavily distorted than in FIG. 10*b* where the pickup is relatively farther away (i.e. pickup height=4.5 mm). This can be modeled as shown in FIG. 9 by a non-linear gain curve that provides a relatively high variation in gain for a pickup height of 1.5 mm, as compared to the more consistent gain for a pickup height at 4.5 mm. Accordingly, the non-linear gain curve 902 can be used provide offsets or gain for differing pickup heights (e.g. 1.5 mm and 4.5 mm) to simulate the non-linearity of the pickup response for an electromagnetic pickup having pickup heights at these distances.

This non-linear distortion effect for a given electromagnetic pickup at given pickup heights can be compensated for by utilizing, for example, a lookup table that describes the non-linear gain of the pickup as previously characterized with a non-linear gain curve 902 as shown in FIG. 9. Moreover, multiple lookup tables can hold non-linear gain curves for each of a wide variety of different electromagnetic pickups that are to be emulated.

Figure 11:
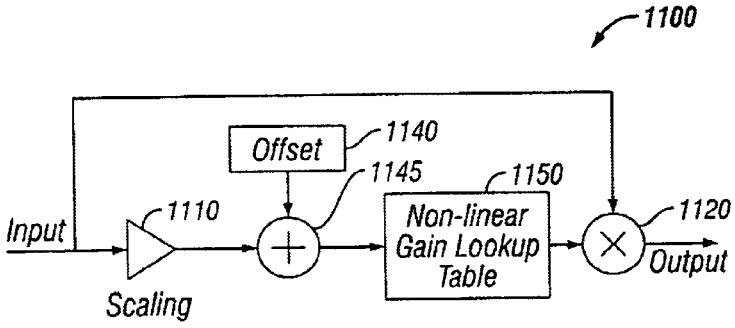
FIG. 11 shows a block diagram of a DSP algorithm that can be utilized for implementing non-linear gain modeling of a string in relation to an electromagnetic pickup at given pickup heights, according to one embodiment of the present invention.

Looking now to FIG. 11, FIG. 11 shows a block diagram of a DSP algorithm 1100 that can be utilized for implementing the non-linear gain modeling of a string in relation to an electromagnetic pickup at given pickup heights, as previously discussed. First, an input digital string vibration signal is scaled by scaling block 1110. The input digital string vibration signal is also directly routed to multiplier block 1120. Particularly, the value of the input digital string vibration signal (e.g. a digital representation of a voltage) is converted to a scaled physical vibration distance amplitude. The vibrating strings 904 and 920 have been scaled to an amplitude of 1 mm.

An offset from offset block 1140 is added by adder block 1145 to simulate the distance from the pickup height being modeled. This offset is added to the scaled physical vibration distance amplitude and provides the input to the non-linear gain lookup table 1150 to find a resultant non-linear gain that should be applied to properly emulate the non-linear distortion of the tone of the string in relation to the height of the particular electromagnetic pickup being modeled. The gain value is multiplied at multiplier block 1120 with the original input digital signal to obtain the emulated digital tone signal being emulated as if it were actually distorted by the real non-linear gain effect of the particular electromagnetic pickup at the specific pickup height.

For example, if the input digital vibration signal of string 904 is scaled to an amplitude of 1 mm and has a scaled vibration distance amplitude reading of 0.3 mm and the pickup height or offset is 1.5 mm, a resultant gain would be found in the non-linear gain lookup table 1150 for a corresponding non-linear gain value for the particular electromagnetic pickup being modeled by getting the value of the gain that corresponds to 1.8 mm (1.5 mm+0.3 mm). The gain value will be multiplied at multiplier block 1120 with the original digital input signal to obtain the emulated digital tone signal, which is emulated as if it were actually distorted by the real non-linear gain effect of the particular electromagnetic pickup at the specific pickup height.

Figure 12:
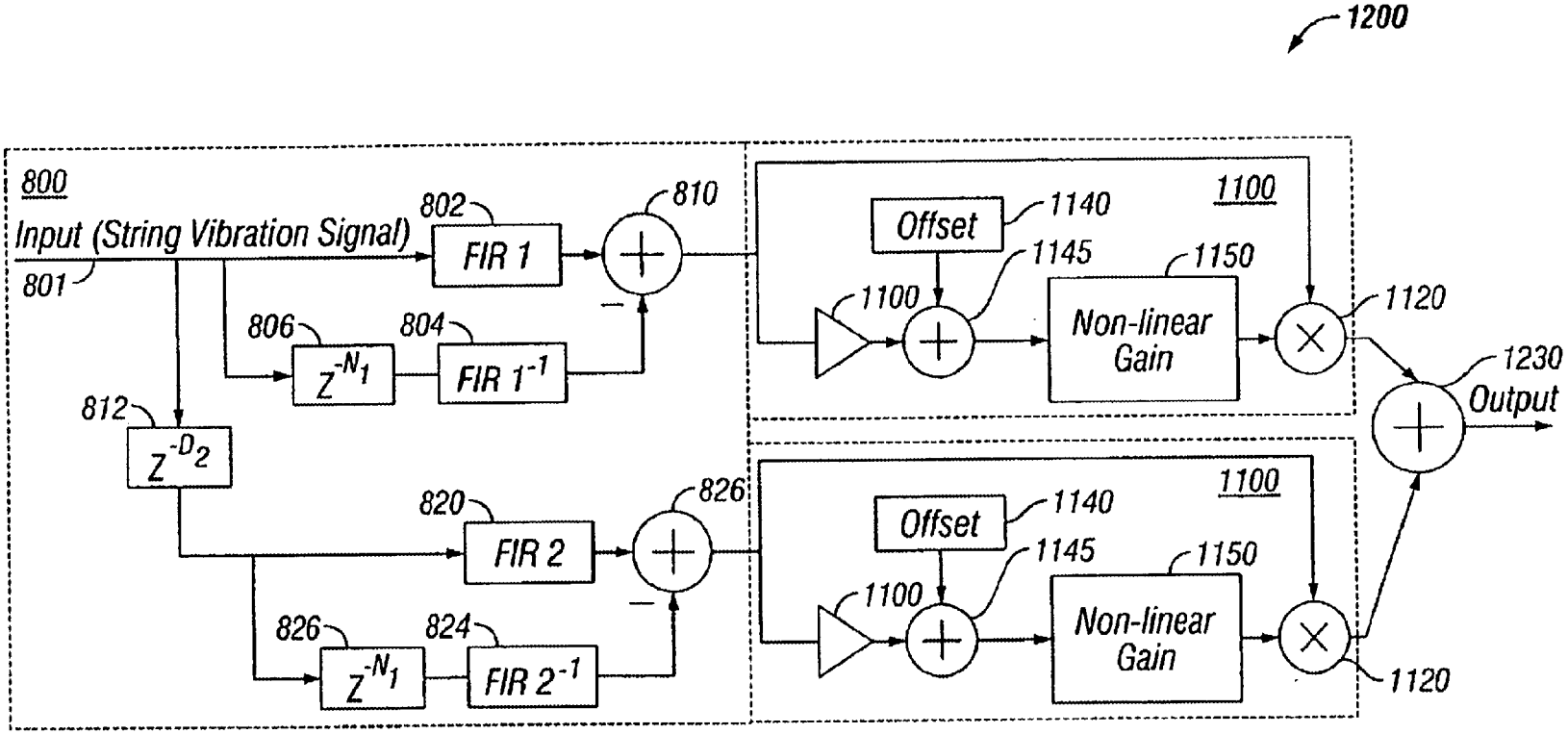
FIG. 12 shows a complete two dimensional example of a generalized block diagram of a DSP algorithm for emulating two electromagnetic pickups located at particular x (horizontal) locations and at particular y (pickup height) displacements along the string of a guitar of a particular guitar to be emulated and further including implementing non-linear gain modeling of the string, according to one embodiment of the present invention.

With reference now to FIG. 12, FIG. 12 shows a complete two dimensional example of a block diagram of a DSP algorithm 1200 for emulating two electromagnetic pickups located at particular x (horizontal) locations and at particular y (pickup height) displacements along the string of a guitar of a particular guitar to be emulated and further including implementing the previously described non-linear gain modeling of a string. As shown in FIG. 12, a input digital string vibration signal 801 for the string enters the DSP block diagram 800. It should be appreciated that DSP block diagram is a representation of the digital transfer function for the emulation of a guitar string of a desired guitar to be emulated with the particular configuration of electromagnetic pickups, previously discussed. However, this DSP block diagram can be generalized to any string of any guitar having two electromagnetic pictures, or any other stringed instrument.

By way of illustration, the input digital string vibration signal 801 is processed by FIR1 802 emulating the magnetic aperture filter response for a first electromagnetic pickup in response to an initial vibration signal and by FIR1$^{-1}$ 804 which is the inverse of FIR1 representing the magnetic aperture filter response for electromagnetic pickup in response to the reflected vibration signal (i.e. reflected from the bridge). Further, the input digital vibration signal is delayed by $z^{-N_1}$ 806 such that the reflected vibration signal is emulated as being delayed by $N_1$ samples. Moreover, the initial and reflected magnetic aperture FIR responses of FIR1 802 and FIR1$^{-1}$ 804 to the input vibration signal 801 are then summed with adder 810 to generate a first emulated digital string vibration signal of the first emulated electromagnetic pickup.

Similarly, after the input vibration signal 801 is delayed by $z^{-D_2}$ 812 such that the response of the second electromagnetic pickup, which is closer to the bridge, is properly delayed relative to the response of the first electromagnetic pickup farthest from the bridge, the input digital string vibration signal 801 is processed by FIR2 820 emulating the magnetic aperture filter response for the second electromagnetic pickup in response to the initial vibration signal and by FIR2$^{-1}$ 824 which is the inverse of FIR2 representing the magnetic aperture filter response for second electromagnetic pickup in response to the reflected vibration signal (i.e. reflected from the bridge). Further, the delayed input vibration signal from the output of delay 812 is delayed by $z^{-N_2}$ 826 such that the reflected vibration signal is modeled as being delayed by $N_2$ samples. Moreover, the initial and reflected magnetic aperture FIR responses of FIR2 820 and FIR2$^{-1}$ 824 to the input vibration signal 801 are then summed with adder 826 to generate a second emulated digital string vibration signal of the second emulated electromagnetic pickup.

Now both the first and second emulated digital string vibrations of the first and second emulated electromagnetic pickups, respectively, are each processed through DSP algorithm blocks 1100 to implement non-linear gain modeling of the string in relation to each electromagnetic pickup at its given pickup height, respectively. Both the first and second emulated digital string vibration signal of the first and second emulated electromagnetic pickups, are scaled by scaling block 1110, respectfully. Each of the first and second emulated digital string vibration signals of the first and second emulated electromagnetic pickups, respectively, are also each directly routed to multiplier block 1120. Particularly, the values of each of the first and second emulated digital string vibration signals of the first and second emulated electromagnetic pickups, respectively, are each converted to a scaled physical vibration distance amplitude, as previously discussed.

An offset from offset block 1140 is added by adder block 1145 to simulate the distance from the pickup height being modeled for each of the first and second emulated digital string vibration signals. This offset is added to the scaled physical vibration distance amplitude and provides the input to the non-linear gain lookup table 1150 to find a resultant non-linear gain that should be applied to properly emulate the non-linear distortion of the tone of the string in relation to the height of the particular electromagnetic pickup being modeled. A gain value is multiplied at multiplier block 1120 with each of the first and second emulated digital string tone signals of the first and second emulated electromagnetic pickups, respectively, to obtain first and second emulated digital string tone signals that are emulated as if they were both actually distorted by the real non-linear gain effect of the first and second electromagnetic pickups at their particular pickup heights, respectively.

Lastly, both the first emulated digital string tone signal of the first emulated electromagnetic pickup and the second emulated digital string tone signal of the second emulated electromagnetic pickup are summed by adder 1230 such that an emulated digital tone signal for the corresponding string of the desired guitar that the user has chosen to be emulated is created. This emulated digital tone signal emulates the string as detected by an electromagnetic pickup at a particular location relative to the string of the desired guitar in both the 'x' and 'y' directions including non-linear gain modeling. This emulated digital tone signal can then be converted to analog format and outputted to an amplifier which can then playback the emulated tone such that the guitar with embedded DSP modeling capabilities sound like the desired guitar chosen by the user.

Thus, a digital transfer function represented by combined DSP block diagram 1200 incorporating predetermined FIR filters having predetermined modeling coefficients, based on impulse responses of the modeled electromagnetic pickups, and calculated delays (DSP block diagram 800), and non-linear modeling in the 'y' axis by DSP block diagrams 1100 is created. This digital transfer function can be used emulate the output signal of the guitar string for the particular guitar chosen by a user in response to a digital input signal from a played string. In other words, based on a digital string vibration signal detected by the bridge, the digital signal processor 120 implementing the particular digital transfer functions (with predetermined modeling coefficients for the particular guitar to be emulated) of combined DSP block diagram 1200 can process the digital string vibration signal to emulate the corresponding string as detected by an electromagnetic pickup at a particular location relative to the string of the modeled guitar (which has a particular configuration of electromagnetic pickups previously modeled) to create an emulated digital tone signal that is modeled in both the 'x' and 'y' axis domains. This emulated digital tone signal can then be converted to analog format and outputted to an amplifier which can then playback the emulated tone such that the guitar with embedded DSP modeling capabilities 100 sounds like the guitar selected by the user. Again, as previously discussed, it should be appreciated by those skilled in the art that the above-described DSP algorithms are used to model pickup locations in two dimensions and that further processing is generally required to ultimately generate an output signal.

Although the previously described combined DSP block diagram 1200 illustrates only one particular example of a DSP block diagram for a guitar having two electromagnetic pickups for a particular guitar string, it should be appreciated by those skilled in the art that the previously described processes and methods of characterizing the guitar string as detected by an electromagnetic pickup at a particular location relative to the string of the guitar with a particular configuration of electromagnetic pickups (in both the 'x' and 'y' axis domains) can be done for any guitar string of any guitar having any number of electromagnetic pickup configurations and strings. Moreover, although described with reference to an electric guitar, it should be appreciated that utilizing the previous described methods and techniques, any stringed instrument can be modeled. Thus, any electrified stringed instrument can be modeled and then emulated utilizing the previously described processes and methods.

Therefore, using embodiments of the invention, a digital transfer function incorporating predetermined FIR filters having predetermined modeling coefficients, based on impulse responses of modeled electromagnetic pickups, and calculated delays, can be created for any guitar or stringed instrument having a given configuration of electromagnetic pickups and any number of strings, and further non-linear gain can be applied to further emulate the non-linear distortion effects of particular electromagnetic pickups at particular pickup heights. Accordingly, a digital transfer function and corresponding DSP block diagram model can be created and used to emulate a output signal for any guitar or stringed instrument in response to a digital input signal from a played string. In other words, based on a digital string vibration signal detected by the pickup, the digital signal processor 120 implementing a particular digital transfer function can process the digital string vibration signal to emulate a corresponding string tone of a desired guitar (in both the 'x' and 'y' axis domains) that the user has chosen to be emulated to create an emulated digital tone signal of the selected guitar. This emulated digital tone signal can then be converted to analog format and outputted to an amplifier which can then playback the emulated tone such that the guitar with embedded DSP modeling capabilities sounds like the desired guitar chosen by the user. Moreover, the embedded DSP allows for the modeling of any stringed instrument, e.g., acoustic guitars, mandolins, basses, etc. For example, in the case of acoustic instruments, standard techniques utilized to model the body resonances of acoustic instruments can be utilized. One such example is the acoustic modeling techniques disclosed in "More Acoustic Sounding Timbre from Guitar Pickups" by Karjalainen, Penttinen, and Valimaki, presented at the Proceedings of the $2^{nd}$ COST G-6 Workshop on Digital Audio Effects (DAFx99), NTNU, Trondheim, Dec. 9–11, 1999, hereby incorporated by reference.

The various aspects of the previously described inventions can be implemented as one or more instructions (e.g. software modules, programs, code segments, etc.) to perform the previously described functions. The instructions which when read and executed by a processor, cause the processor to perform the operations necessary to implement and/or use embodiments of the invention. Generally, the instructions are tangibly embodied in and/or readable from a machine-readable medium, device, or carrier, such as memory, data storage devices, and/or remote devices. The instructions may be loaded from memory, data storage devices, and/or remote devices into memory for use during operations. The instructions can be used to cause a general purpose or special purpose processor, which is programmed with the instructions to perform the steps of the present invention. Alternatively, the features or steps of the present invention may be performed by specific hardware components that contain hard-wired logic for performing the steps, or by any combination of programmed computer components and custom hardware components.

While the present invention and its various functional components have been described in particular embodiments, it should be appreciated the embodiments of the present invention can be implemented in hardware, software, firmware, middleware or a combination thereof and utilized in systems, subsystems, components, or sub-components thereof When implemented in software (e.g. as a software module), the elements of the present invention are the instructions/code segments to perform the necessary tasks. The program or code segments can be stored in a machine readable medium, such as a processor readable medium or a computer program product, or transmitted by a computer data signal embodied in a carrier wave, or a signal modulated by a carrier, over a transmission medium or communication link. The machine-readable medium or processor-readable medium may include any medium that can store or transfer information in a form readable and executable by a machine (e.g. a processor, a computer, etc.). Examples of the machine/processor-readable medium include an electronic circuit, a semiconductor memory device, a ROM, a flash memory, an erasable programmable ROM (EPROM), a floppy diskette, a compact disk CD-ROM, an optical disk, a hard disk, a fiber optic medium, a radio frequency (RF) link, etc. The computer data signal may include any signal that can propagate over a transmission medium such as electronic network channels, optical fibers, air, electromagnetic, RF links, etc. The code segments may be downloaded via computer networks such as the Internet, Intranet, etc.

While this invention has been described with reference to illustrative embodiments, this description is not intended to be construed in a limiting sense. Various modifications of the illustrative embodiments, as well as other embodiments of the invention, which are apparent to persons skilled in the art to which the invention pertains are deemed to lie within the spirit and scope of the invention.

What is claimed is:

1. A stringed instrument with embedded digital signal processing (DSP) modeling capabilities, the stringed instrument having a body and at least one string, the stringed instrument comprising:

a bridge pickup located at a bridge of the stringed instrument to which a string is coupled, the bridge pickup to detect a vibration signal of the string;

an analog to digital converter to convert the detected vibration signal of the string into a digital string vibration signal; and a digital signal processor located within the body of the stringed instrument to process the digital string vibration signal to emulate a corresponding string tone of one of a plurality of stringed instruments to create an emulated digital tone signal wherein the emulation of the corresponding string tone for an emulated stringed instrument includes emulating a location of an electromagnetic pickup away from a bridge of the emulated stringed instrument.

2. The stringed instrument of claim 1, wherein, the emulated digital tone signal is converted to analog form to create an emulated analog tone signal for output to an amplification device.

3. The stringed instrument of claim 1, further comprising a user interface located on the body of the stringed instrument to allow a user to select one of a plurality of stringed instruments to be emulated.

4. The stringed instrument of claim 3, further comprising a control processor coupled to the user interface to provide modeling coefficients from a memory to the digital signal processor for the stringed instrument selected by the user.

5. The stringed instrument of claim 1, wherein the emulation of a corresponding string tone of one of a plurality of stringed instruments includes utilizing a finite impulse response (FIR) filter.

6. The stringed instrument of claim 1, wherein the emulation of the corresponding string tone for the emulated stringed instrument further includes emulating a pickup height of the electromagnetic pickup.

7. The stringed instrument of claim 6, wherein emulating the pickup height of an electromagnetic pickup includes applying a non-linear gain to model non-linear distortion associated with the pickup height of the electromagnetic pickup for the corresponding string tone of the emulated stringed instrument.

8. The stringed instrument of claim 1, wherein the emulated digital tone signal undergoes further digital signal processing to emulate one of a plurality of amplifiers and cabinet setups.

9. The stringed instrument of claim 1, wherein processing the digital string vibration signal further comprises emulating corresponding string tones for a plurality of different stringed instruments simultaneously.

10. The stringed instrument of claim 2, wherein the plurality of stringed instruments to be emulated includes a plurality of guitars.

11. The stringed instrument of claim 10, wherein the emulated analog vibration signal of the corresponding string tone of one of the plurality of guitars is transmitted to the amplification device utilizing a standard guitar cable.

12. A guitar with embedded digital signal processing (DSP) modeling capabilities, the guitar having a body and at least one string, the guitar comprising:

a bridge pickup located at a bridge of the stringed instrument to which a string is coupled, the bridle pickup to detect a vibration signal of the string;

an analog to digital converter to convert the detected vibration signal of the string into a digital string vibration signal; and a digital signal processor located within the body of the guitar to process the digital string vibration signal to emulate a corresponding string tone of one of a plurality of guitars to create an emulated digital tone signal wherein the emulation of the corresponding string tone for an emulated guitar includes emulating a location of an electromagnetic pickup away from a bridge of the emulated stringed instrument.

13. The guitar of claim 12, wherein, the emulated digital tone signal is converted to analog form to create an emulated analog tone signal for output to an amplification device.

14. The guitar of claim 12, further comprising a user interface located on the body of the guitar to allow a user to select one of a plurality of guitars to be emulated.

15. The guitar of claim 14, further comprising a control processor coupled to the user interface to provide modeling coefficients from a memory to the digital signal processor for the guitar selected by the user.

16. The guitar of claim 12, wherein the emulation of a corresponding string tone of one of a plurality of guitars includes utilizing a finite impulse response (FIR) filter.

17. The guitar of claim 12, wherein the emulation of the corresponding string tone for the emulated guitar further includes emulating a location and a pickup.

18. The guitar of claim 17, wherein emulating the pickup height of an electromagnetic pickup includes applying a non-linear gain to model non-linear distortion associated with the pickup height of the electromagnetic pickup for the corresponding string tone of the emulated guitar.

19. The guitar of claim 12, wherein the emulated digital tone signal undergoes further digital signal processing to emulate one of a plurality of amplifiers and cabinet setups.

20. The guitar of claim 12, wherein processing the digital string vibration signal further comprises emulating a corresponding string tone for a plurality of guitars simultaneously.

21. The guitar of claim 13, wherein the emulated analog vibration signal of the corresponding string tone of one of the plurality of guitars is transmitted to the amplification device utilizing a standard guitar cable.

22. A method of emulating a plurality of different stringed instruments with a stringed instrument having embedded digital signal processing (DSP) modeling capabilities, the method comprising:

detecting a vibration signal of at least one string at a bridge pickup located at a bridge of the stringed instrument;

converting the detected vibration signal of the string into a digital string vibration signal; and processing the digital string vibration signal within the stringed instrument to emulate a corresponding string tone of one of a plurality of stringed instruments to create an emulated digital tone signal wherein the emulation of the corresponding string tone for an emulated stringed instrument includes emulating a location of an electromagnetic pickup away from a bridge of the emulated stringed instrument.

23. The method of claim 22, wherein the emulated digital tone signal is converted to analog form to create an emulated analog tone signal for output to an amplification device.

24. The method of claim 22, wherein the vibration signal is detected with a pickup.

25. The method of claim 22, further comprising allowing a user to select one of a plurality of stringed instruments to be emulated with a user interface, the user interface being located on the stringed instrument.

26. The method of claim 25, further comprising providing modeling coefficients from a memory for use in emulating the stringed instrument selected by the user.

27. The method of claim 22, wherein the emulation of a corresponding string tone of one of a plurality of stringed instrument includes utilizing a finite impulse response (FIR) filter.

28. The method of claim 22, wherein the emulation of the corresponding string tone for the emulated stringed instrument further includes emulating a pickup height of the electromagnetic pickup.

29. The method of claim 28, wherein emulating the pickup height of an electromagnetic pickup includes applying non-linear gain to model non-linear distortion associated with the pickup height of the electromagnetic pickup for the corresponding string of the emulated stringed instrument.

30. The method of claim 22, wherein the emulated digital tone signal undergoes further digital signal processing to emulate one of a plurality of amplifiers and cabinet setups.

31. The method of claim 22, wherein processing the digital string vibration signal further comprises emulating corresponding string tones for a plurality of different stringed instruments simultaneously.

32. The method of claim 22, wherein the plurality of stringed instruments to be emulated includes a plurality of guitars.

33. The method of claim 23, wherein the emulated analog vibration signal of the corresponding string tone of one of the plurality of guitars is transmitted to the amplification device utilizing a standard guitar cable.

34. A processor-readable medium having stored thereon instructions, which when executed by a processor in a stringed instrument having embedded digital signal processing (DSP) modeling capabilities, cause the processor to perform the following operations:

detecting a vibration signal of at least one string at a bridge pickup located at a bridge of the stringed instrument;

converting the detected vibration signal of the string into a digital string vibration signal; and processing the digital string vibration signal within the stringed instrument to emulate a corresponding string tone of one of a plurality of stringed instruments to create an emulated digital tone signal wherein the emulation of the corresponding string tone for an emulated stringed instrument includes emulating a location of an electromagnetic pickup away from a bridge of the emulated stringed instrument.

35. The processor-readable medium of claim 34, wherein the emulated digital tone signal is converted to analog form to create an emulated analog vibration signal for output to an amplification device.

36. The processor-readable medium of claim 34, wherein the vibration signal is detected with a pickup.

37. The processor-readable medium of claim 34, further comprising allowing a user to select one of a plurality of stringed instruments to be emulated with a user interface, the user interface being located on the stringed instrument.

38. The processor-readable medium of claim 37, further comprising providing modeling coefficients from a memory for use in emulating the stringed instrument selected by the user.

39. The processor-readable medium of claim 34, wherein the emulation of a corresponding string tone of one of a plurality of stringed instrument includes utilizing a finite impulse response (FIR) filter.

40. The processor-readable medium of claim 34, wherein the emulation of the corresponding string tone for the emulated stringed instrument further includes emulating a pickup height of the electromagnetic pickup.

41. The processor-readable medium of claim 40, wherein emulating the pickup height of an electromagnetic pickup includes applying a non-linear gain to model non-linear distortion associated with the pickup height of the electromagnetic pickup for the corresponding string of the emulated stringed instrument.

42. The processor-readable medium of claim 34, wherein the emulated digital tone signal undergoes further digital signal processing to emulate one of a plurality of amplifiers and cabinet setups.

43. The processor-readable medium of claim 34, wherein processing the digital string vibration signal further comprises emulating corresponding string tones for a plurality of different stringed instruments simultaneously.

44. The processor-readable medium of claim 35, wherein the plurality of stringed instruments to be emulated includes a plurality of guitars.

45. The processor-readable medium of claim 44, wherein the emulated analog vibration signal of the corresponding string of one of the plurality of guitars is transmitted to the amplification device utilizing a standard guitar cable.

* * * * *